US005878658A

United States Patent [19]

Ackley

[11] Patent Number: 5,878,658

[45] Date of Patent: Mar. 9, 1999

[54] APPARATUS AND METHOD FOR MARKING TWO SIDES OF A PELLET-SHAPED ARTICLE

[75] Inventor: E. Michael Ackley, Stone Harbor, N.J.

[73] Assignee: Ackley Machine Corporation, Moorestown, N.J.

[21] Appl. No.: 980,796

[22] Filed: Dec. 1, 1997

[51] Int. Cl.[6] ..... B41F 17/00

[52] U.S. Cl. ..... 101/35; 101/483

[58] Field of Search ..... 101/35, 36, 37, 101/38.1, 39, 40, 40.1, 41–43, 483

[56] References Cited

U.S. PATENT DOCUMENTS

| | | | |
|---|---|---|---|
| 3,103,165 | 9/1963 | Tripp | 101/35 |
| 3,884,143 | 5/1975 | Ackley | 101/37 |
| 3,889,591 | 6/1975 | Nogouchi | 101/37 |
| 4,189,996 | 2/1980 | Ackley, Sr. et al. | 101/37 |
| 4,367,702 | 1/1983 | Ackley | 101/40 |
| 4,672,892 | 6/1987 | Ackley | 101/35 |
| 4,905,589 | 3/1990 | Ackley | 101/35 |
| 5,376,771 | 12/1994 | Roy | 219/121.71 |
| 5,433,146 | 7/1995 | Ackley | 101/35 |
| 5,630,499 | 5/1997 | Louden et al. | 198/803.1 |

FOREIGN PATENT DOCUMENTS 0 477 395 A1 4/1992 European Pat. Off. .

*Primary Examiner*—Edgar Burr
*Assistant Examiner*—Dave A. Ghatt
*Attorney, Agent, or Firm*—Oliff & Berridge, PLC

[57] ABSTRACT

A pellet-shaped article marking system marks two sides of a pellet-shaped article. A hopper is disposed over a ramp-type conveyor and feeds pellet-shaped articles onto the conveyor. A first marking device marks a first side of the pellet-shaped articles. A pickup drum receives the pellet-shaped articles from the conveyor and transports them to a second marking device so that a non-marked side of the articles faces the second marking device. The second marking device marks the non-marked side of the articles. The pickup drum then discharges the pellet-shaped articles into a bin.

12 Claims, 7 Drawing Sheets

APPARATUS AND METHOD FOR MARKING TWO SIDES OF A PELLET-SHAPED ARTICLE

BACKGROUND OF THE INVENTION

1. Field of Invention

The present invention relates to an apparatus and method for marking at least two sides of a pellet-shaped article. In particular, the invention relates to an apparatus and method for marking both sides of a pellet-shaped article using a ramp-type conveyor system with at least one row of article receiving pockets.

2. Description of Related Art

A variety of devices have been developed for printing indicia on pellet-shaped articles using a conveyor system. Some of these devices are capable of simultaneously printing indicia on both sides of an article, while other devices are only capable of printing indicia on a single side of the articles.

For example, U.S. Pat. No. 4,189,996 to Ackley, Sr. et al. discloses an article carrying device (e.g. carrier) for printing indicia on both sides of a single row of articles. The carrier is specially designed to have a housing with two open sides so as to entrain the articles entirely therein. This configuration allows the sides of the articles to be exposed to printers placed on both sides of the carrier. That is, once the articles are entrained within the carrier, both sides of the articles face opposing printing devices. In order for printing to be accomplished, the carriers are positioned on the conveyor system and transported along a predetermined path past the opposing printers for simultaneously printing indicia on both sides of the articles.

However, in operation only one row of articles can be printed at a time using these carriers because the carriers are aligned in a single row on the conveyer so that the printers can be placed on opposing sides of the articles for printing. Also, when using these carriers, special article feed dispensers are needed to ensure that the articles are entirely entrained within the carriers. However, even when using the special article feed dispensers, the articles are not always dispensed properly into the carriers, thereby resulting in many carriers passing the printers without having articles entrained therein.

Other article carrying devices are designed so that indicia can be printed on a single side of the article. For example, U.S. Pat. No. 3,884,143 to Ackley discloses a tablet carrier link for precision printing. The link includes a supporting base connected to a conveyor. The link has a hollow body portion providing a space for an article. At least one side of the link is open for exposing a part of the article for printing. Like the Ackley Sr. patent, only one row of articles can be printed at a time using these links because the links are aligned in single fashion on the conveyor so that printing can be performed effectively.

By way of another example, U.S. Pat. No. 5,433,146 to Ackley discloses specially designed carrier bars for entraining articles. These carrier bars contain specially designed pockets so that articles can be substantially placed therein so that only one side of the article faces a printer. The carrier bars are fixed to a ramp-type conveyor system that transports the carrier bars along a predefined path and underneath a printer for printing indicia on the articles. Because the articles are placed within the pockets of the carrier bars, the sides of the articles are covered and indicia can only be printed on the top or one side of each of the articles.

SUMMARY OF THE INVENTION

One aspect of the invention is directed towards a pellet-shaped article marking system that marks both sides of a pellet-shaped article. In embodiments, a hopper is disposed over a ramp-type conveyor and feeds the articles into carrier bars. The carrier bars are disposed on the conveyor and are transported along a predefined path. The carrier bars are transferred past a first marking device that marks a first side of the pellet-shaped articles. The carrier bars are then transported to a pickup drum which receives the articles from the carrier bars and transports them to a second marking device. In the pickup drum, the articles are oriented towards the second marking device. The second marking device then marks a non-marked side of the articles.

A method of marking both sides of the articles is also provided.

These and other aspects and salient features of the invention will be described in or apparent from the following detailed description of preferred embodiments.

BRIEF DESCRIPTION OF THE DRAWINGS

Preferred embodiments of the invention will be described in conjunction with the following drawings in which.

DETAILED DESCRIPTION OF PREFERRED EMBODIMENTS

An apparatus and method for marking both sides of a pellet-shaped article is disclosed. The dimensions of the invention, including length, width, shape and other variables and quantities specified herein may vary with the type of system contemplated. Therefore, numbers and dimensions specified herein are not to be construed as limitations on the scope of the present invention. These numbers and dimensions are meant to be merely illustrative of one particular application.

Figure 1:
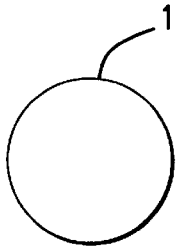
FIG. 1 shows one example of a pellet-shaped article.

FIG. 1 shows a pellet-shaped article (e.g. article), generally depicted as 1. For illustrative purposes only, the article 1 is a round tablet. Other articles such as capsules, tablets, caplets (e.g. solid, oval or irregular shaped tablets) and other pharmaceutical and confectionery articles are contemplated for use with the present invention.

Figure 2:
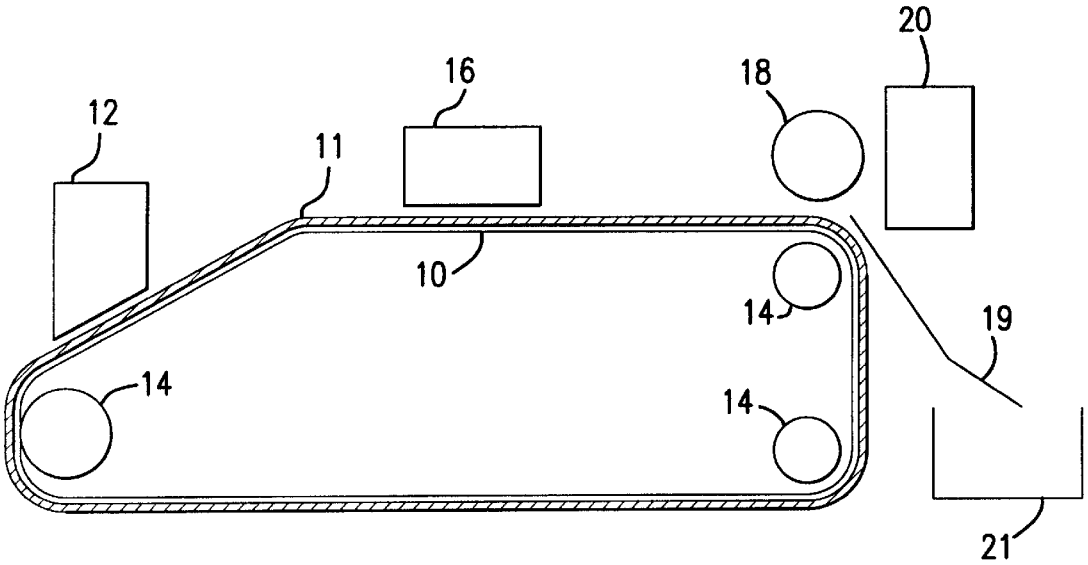
FIG. 2 shows a plan view of one embodiment of the invention.

FIG. 2 shows an embodiment of the present invention. A feed hopper 12 (e.g., dispenser) dispenses a plurality of articles onto a conveyer 10 having a plurality of carrier bars 11. The conveyor 10 follows a predefined path defined by a plurality of sprockets 14. The sprockets may be motorized for moving the conveyor 10 and for transporting the articles along the predefined path. In embodiments, the conveyer is a ramp type conveyor as disclosed in U.S. Pat. No. 5,433,146 to Ackley, incorporated hereinafter by reference in its entirety.

The conveyor 10 transports the articles to a first marking device 16. In embodiments, the first marking device is a first printer. Other marking devices, such as etching devices and drilling devices, such as the drilling device disclosed in U.S. Pat. No. 5,376,771 are also contemplated for use by the present invention. The first printer prints indicia on one side of the article. The first printer, for example, may be a laser printer, an ink jet printer, a spin printer or other well known printer capable of printing indicia on articles.

The articles are then transported to a pick up drum 18. In embodiments, the pick up drum 18 orients the articles so that a non-marked (e.g. non-printed) side of the articles faces a second marking device 20. In embodiments, the second marking device 20 is located adjacent to the pickup drum 18 and, for example, may be a second printer which prints indicia on the non-printed side of the articles.

After the second marking device 20 marks the articles, the pickup drum 18 releases the articles into a chute 19. The chute 19 transports the articles into a drop off bin 21 for future packaging, inspection or other processes well known in the art.

Figure 3:
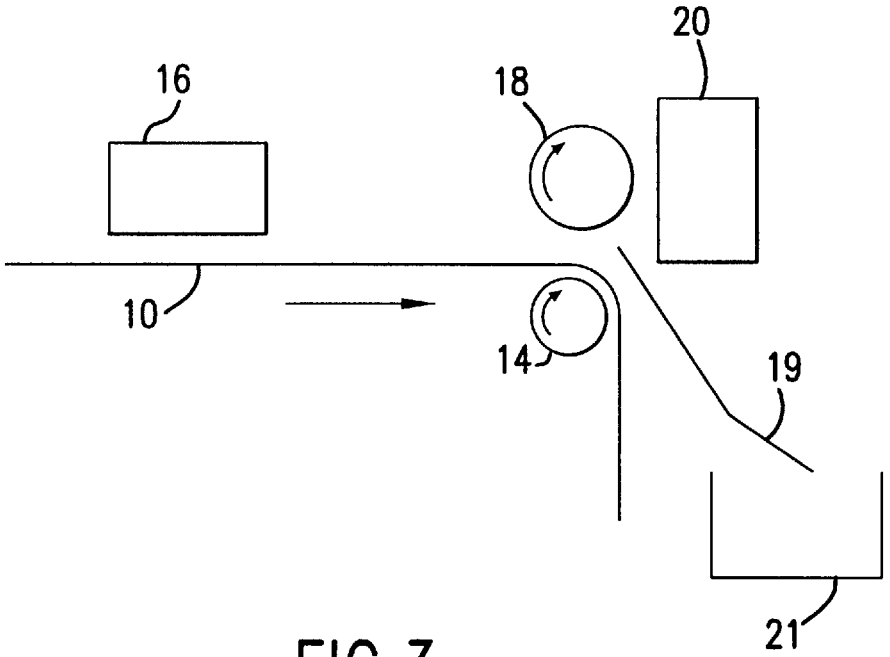
FIG. 3 shows an embodiment of the invention.

FIG. 3 shows an embodiment of the present invention. In this embodiment, the pickup drum 18 and the conveyor both rotate in a clockwise direction. At a tangential line formed between the conveyor 10 and the pickup drum 18, the pickup drum and the conveyor 18 are moving in opposite directions. This results in the pickup drum "grabbing" the articles as they pass underneath the pickup drum 18, the articles then orient so that the non-marked (e.g., non-printed) sides face the second marking device 20 (e.g., second printer).

Figure 4:
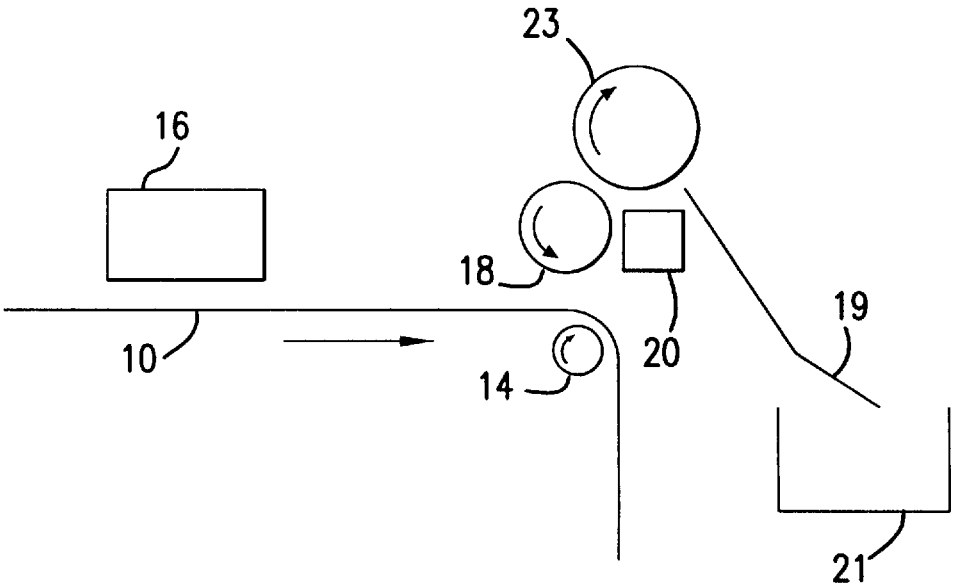
FIG. 4 shows another embodiment of the invention.

FIG. 4 shows another embodiment of the invention. In this embodiment, the pickup drum 18 rotates counterclockwise such that a tangential speed of the drum 18 substantially matches the speed and direction of the conveyor 10. A transfer drum 23 rotating in a direction opposite to that of the pickup drum 18 is also provided. In embodiments, the pickup drum 18 receives the articles after the first marking device 16 (e.g., first printer) prints indicia on one side of the articles. The pickup drum 18 orients the articles so that the non-marked (e.g., non-printed) side of the article faces the second marking device 20 (e.g., second printer). After printing has been performed by the second printer, the transfer drum 23 receives the articles from the pickup drum 18 and transports the articles to the chute 19. The articles are transported to the drop off bin 21. In embodiments, the diameter of transport drum 23 is larger than the diameter of the pickup drum 18.

Figure 5:
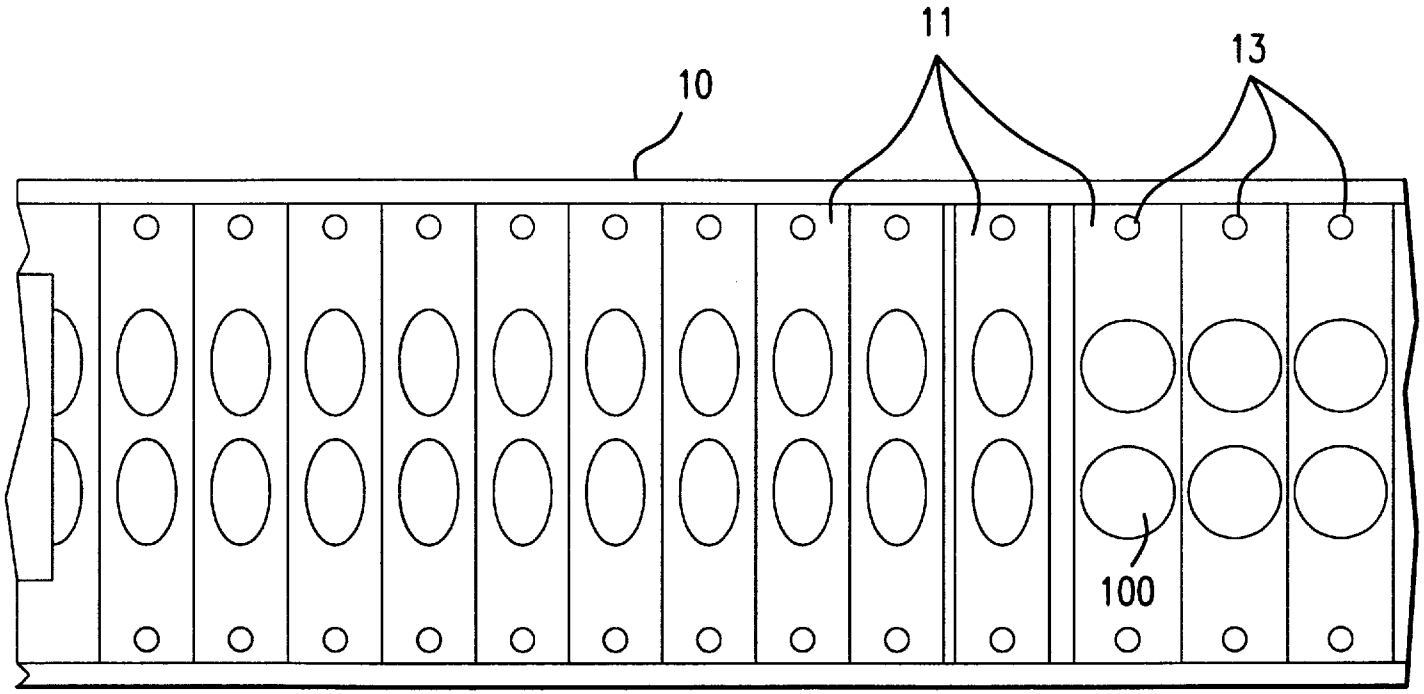
FIG. 5 shows carrier bars according to the invention.

FIG. 5 shows a plurality of carrier bars 11. Each carrier bar 11 is connected to the conveyor 10 using screws or a quick release mechanism 13 as disclosed in U.S. Pat. No. 5,630,499, assigned to Ackley Machine Corporation, and comprises pockets 100 located on a top surface of the carrier bar 11. The pockets 100 receive the articles as they are dispensed from the dispenser 12 onto the conveyor 10. The pockets 100 are preferably designed so that only a top side of the articles are exposed to the first marking device 16 and the remaining portions of the articles are completely entrained within the pockets 100. In embodiments, a plurality of carrier bars 11 are linked to one another via a chain to form a substantially continuous surface disposed about the conveyor 10. This ensures that the articles being dispensed from the dispenser 12 are efficiently placed within the pockets 100 of the carrier bars 11. A plurality of rows may be formed by the pockets 100 so that several articles may be simultaneously printed by the first and second printers. Also, the carrier bars 11 may have scalloped edges and/or the pockets may be interlaced or staggered as shown in U.S. Pat. No. 5,433,146.

Figure 6:
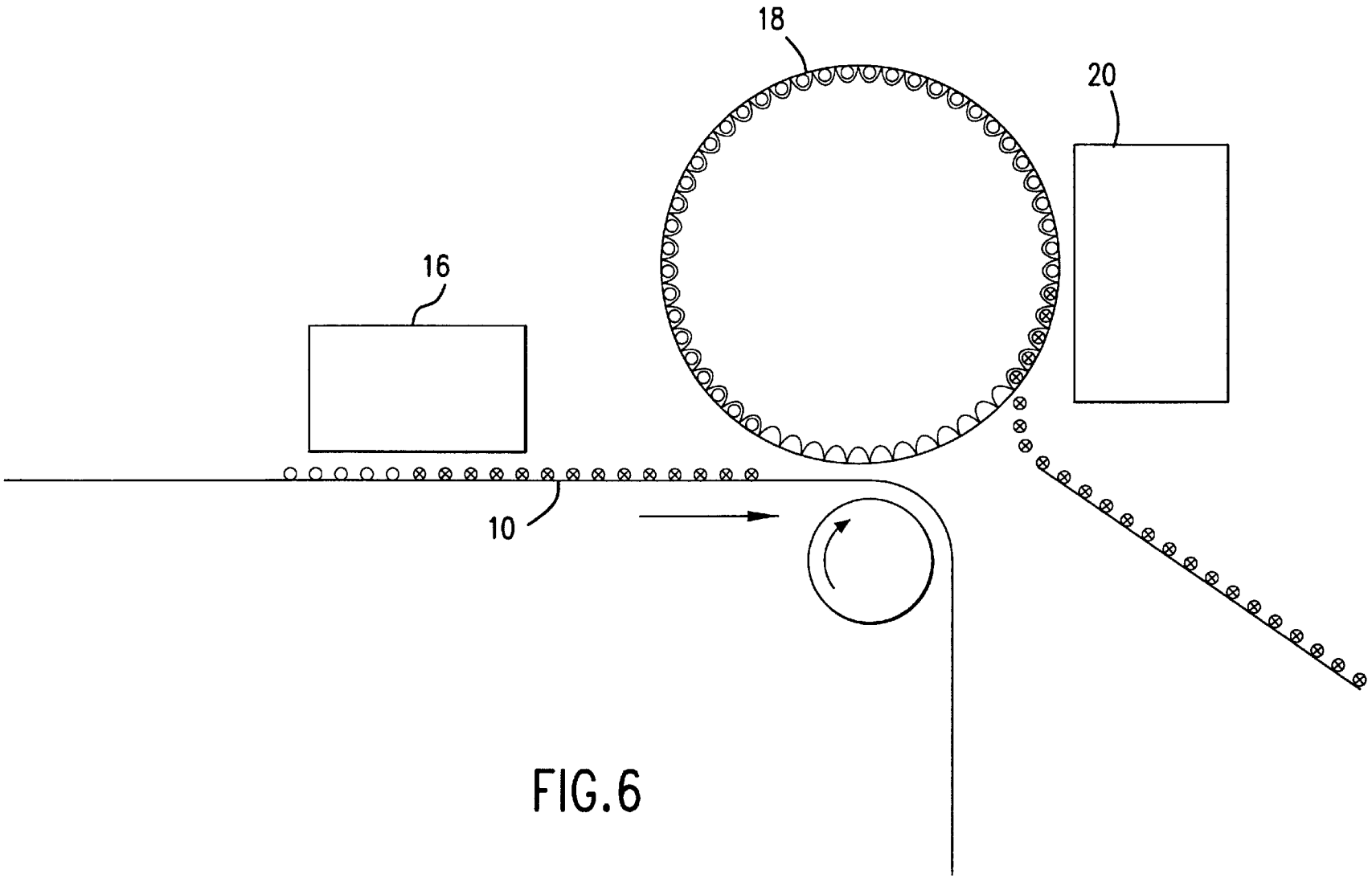
FIG. 6 shows a pickup drum according to the invention.

FIG. 6 shows the pickup drum 18. The pickup drum 18 compromises a plurality of vacuum seats 30 which, for example, may receive the articles when the articles pass substantially underneath or adjacent to a corresponding vacuum seat 30. In embodiments, the pickup drum 18 is located on a horizontal section of the conveyor 10, downstream from the first marking device 16. The pickup drum 18 may also be located at other positions relative to the conveyor 10.

In embodiments, the plurality of vacuum seats 30, for example, may be synchronized with the movement of the conveyor 10 so that each one of the articles entrained within the pockets 100 of the carrier bars 11 substantially aligns with the corresponding vacuum seat 30. This allows the vacuum seats 30 to receive each one of the articles as they are conveyed on the conveyor 10 after the first printer prints indicia on one side of the articles. As further seen in FIG. 6, after indicia (e.g., "X") has been printed on the top or exposed side of the articles by the first printer 16, the pickup drum 18 then orients the articles so that indicia (e.g., "Y") may be printed on the non-printed side of the article (opposite to the top side) by the second printer 20.

Figure 7:
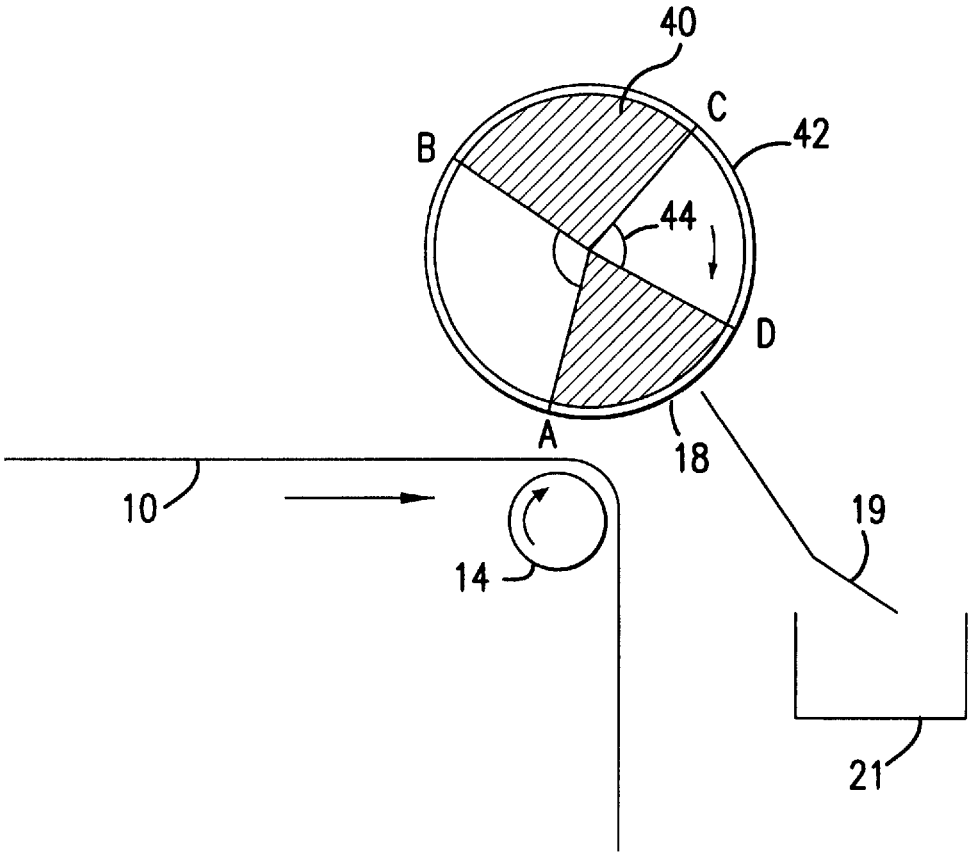
FIG. 7 shows an exploded view of the pickup drum of FIGS. 2 and 3.

FIG. 7 shows a cross section view of an embodiment of the pickup drum 18. In embodiments, the pickup drum 18 compromises a shell 42 and an inner shoe 40. A vacuum 44 is placed within the pickup drum 18 so that individual vacuum seats 30 can be individually activated and/or deactivated. When the vacuum seats 30 are unencumbered by the shoe 40, the articles are exposed to a vacuum and received within the vacuum seats 30. In embodiments, when the vacuum seats are deactivated (covered by the shoe 40) the articles, for example, may be held in the vacuum seats 30 by gravity or discharged from the vacuum seats 30 and transported via the chute 19 to the drop off bin 21.

In embodiments, the outer shell 42 revolves around the inner shoe 40, while the inner shoe 40 remains stationary. Individual vacuum seats are deactivated as they pass the inner shoe 40. That is, when the shell 42 is substantially directly over the inner shoe 40, the vacuum seats are deactivated.

As further seen in FIG. 7, the vacuum seats 30 are activated substantially between point A and point B. The vacuum seats 30 may also be activated substantially between point C and point D. Accordingly, in embodiments, at point A the articles are received within the individual vacuum seats 30 and remain within the vacuum seats 30 until they reach point B. Between point B and point C, gravity holds the articles in the vacuum seats 30 and between point C and point D the vacuum seats 30 are reactivated. Printing may be performed between point C and point D. At substantially near point D, the articles may be discharged from the pickup drum 18 and transported to the drop off bin 21 via the chute 19. The individual vacuum seats 30 may again be reactivated at substantially near point A so that the process may begin again.

Figure 8:
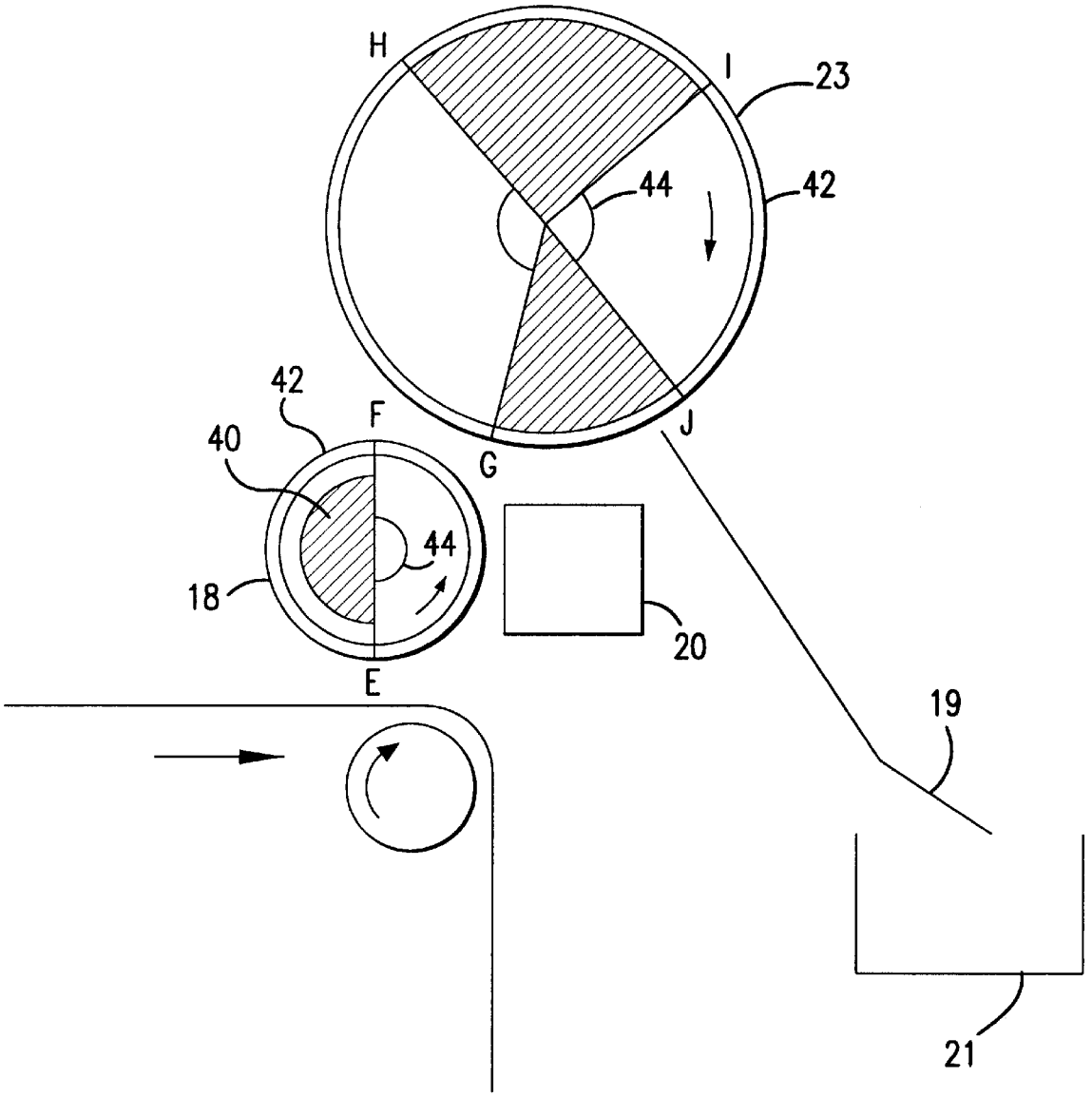
FIG. 8 shows an exploded view of the pickup drum and transport drum of FIG. 4.

FIG. 8 shows the pickup drum 18 and transfer drum 23 of the embodiment of FIG. 4. In embodiments, the individual vacuums seats 30 of the pickup drum 18 are activated between point E and point F adjacent the second printer 20 and deactivated between point F and point E adjacent a side where the dispenser 12 is located. The transport drum 23 also compromises individual vacuum seats 30, an inner shoe 40 and a shell 42. The individual vacuum seats 30 are activated between point G and point H and point I and point J and deactivated between point H and point I and point J and point G. In embodiments, the transfer drum 23 is larger than the pickup drum 18 so that the articles, for example, may be transported past the second printer and discharged into the chute 19. The vacuum seats 30 on the transport drum 23 are preferably synchronized with the vacuum seats 30 of the pickup drum 18 so that the articles may be transported from the pickup drum 18 to the transport drum 23 after the second printer has printed indicia on the articles.

Method of Use

Figure 9:
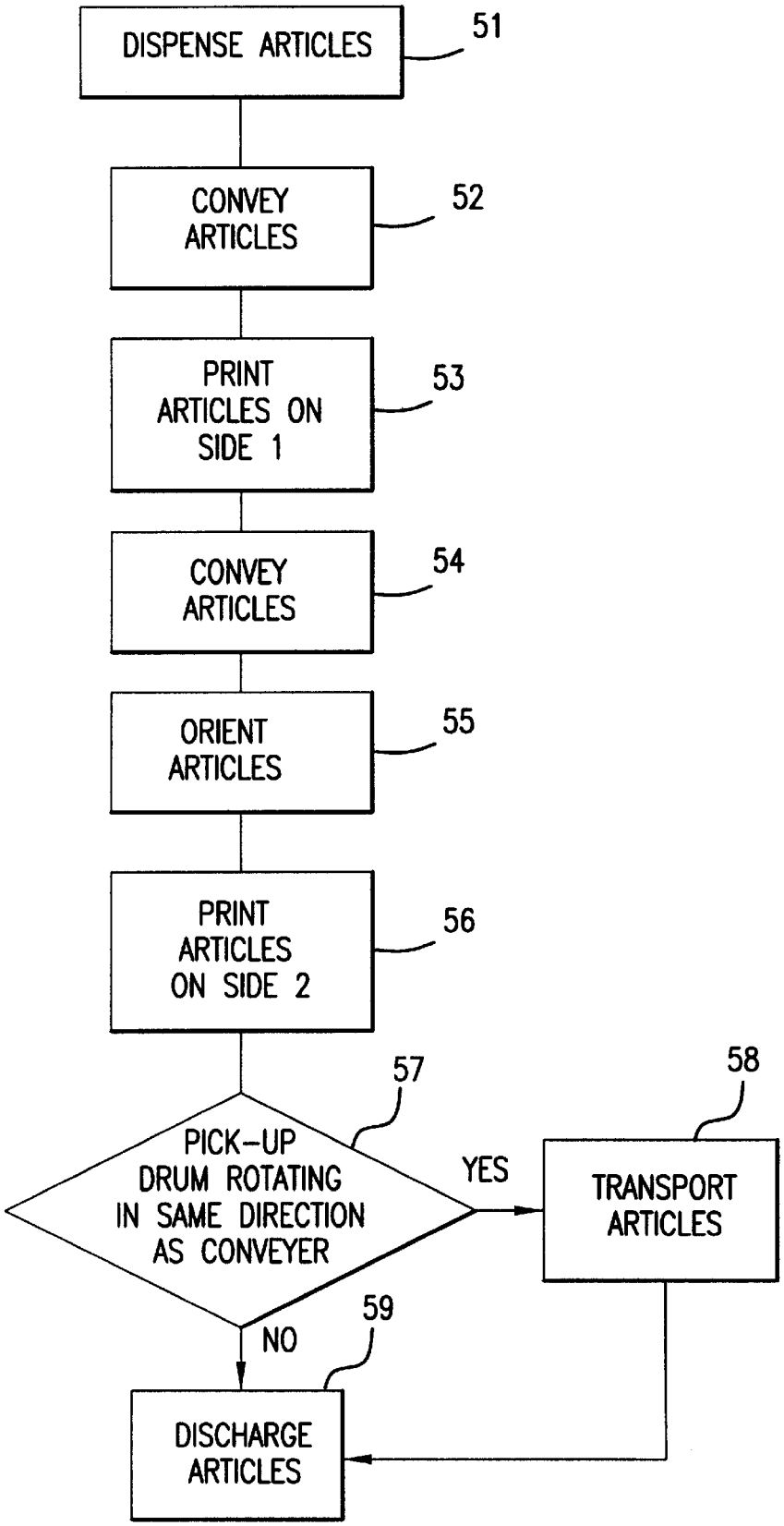
FIG. 9 shows a flow chart of a method of printing indicia on articles.

FIG. 9 shows a flow diagram of the method of use of the invention. At Step S1 the articles are dispensed from the dispenser onto the conveyor. At Step S2 the articles are conveyed to the first printer. In Step S3 the first printer prints indicia on a first side of the articles. The articles are then transported to the pickup drum at Step S4. At Step S5 the pickup drum orients the articles so that a non-marked side of the articles faces the second printer. The second printer prints indicia on the non-marked sides of the articles at Step S6. At Step S7 a decision is made as to whether the pickup drum rotates in a clockwise direction. If the pickup drum rotates in a clockwise direction (e.g., the same direction as the direction of rotation of the conveyor), the articles are discharged into the discharge bin at Step S9. If the pickup drum rotates in a counterclockwise direction (e.g., the opposite direction of rotation of the conveyor), the transport drum receives the articles from the pickup drum (Step S8) and discharges them into the drop off bin at Step S9.

Preferred and alternate embodiments of the apparatus and method for marking both sides of a pellet-shaped article have now been described in detail. It is to be noted, however, that this description is merely illustrative of the principles underlying the inventive concept. It is therefore contemplated that various modifications of the disclosed embodiments will, without departing from the spirit and scope of the invention, be apparent to persons of ordinary skill in the art.

What is claimed is:

1. A pellet-shaped article marking apparatus comprising:

a pellet-shaped article dispenser dispensing at least one row of a plurality of pellet-shaped articles;

a ramp-type conveyor having an incline portion and horizontal portion, said conveyor receiving the pellet-shaped articles from the dispenser, the pellet-shaped articles having only a first side exposed while being conveyed on the conveyor;

a first marking device located above the horizontal portion of the conveyor and downstream from the pellet-shaped article dispenser, the first marking device marking the first side of the pellet-shaped articles;

a pickup drum located downstream from the first marking device above the horizontal portion of the conveyor, the pickup drum orienting the pellet-shaped articles so that the first side is no longer exposed and a second side of the pellet-shaped article is exposed; and a second marking device located proximate to the pickup drum, the second marking device marking only the second side of the pellet-shaped articles.

2. The apparatus of claim 1, wherein the second marking device is a printer.

3. The apparatus of claim 1, wherein the first marking device is a printer.

4. The apparatus of claim 1, wherein the pickup drum includes a plurality of receiving holes.

5. The apparatus of claim 4, wherein the receiving holes are vacuum seats.

6. The apparatus of claim 5, wherein an interior portion of the pickup drum includes an inner shoe, the inner shoe activating and deactivating the vacuum seats.

7. An apparatus for marking two sides of a plurality of pellet-shaped articles comprising:

ramp-type conveying means for conveying a plurality of rows of the pellet-shaped articles, said conveying means including an incline portion and a horizontal portion;

first marking means positioned above the horizontal portion of the conveying means for marking a first side of the pellet-shaped articles;

manipulation means positioned above the horizontal portion of the conveying means for manipulating the pellet-shaped articles so that only a second side of the pellet-shaped articles is exposed; and second marking means for marking only the second side of the pellet-shaped articles.

8. The apparatus of claim 7, wherein:

the first marking means is first printing means; and the second marking means is second printing means.

9. The apparatus of claim 7, wherein the manipulation means includes a pickup drum that rotates in a direction opposite of that of the conveying means.

10. The apparatus of claim 7, wherein the manipulation means and the conveying means rotate in a common direction.

11. A method of marking pellet-shaped articles comprising:

conveying the pellet-shaped articles using a ramp-type conveyor having an incline portion and a horizontal portion, a first side of the pellet-shaped articles being exposed;

marking the first side of the pellet-shaped articles with a first marking device positioned above the horizontal portion of the conveyor;

manipulating the pellet-shaped articles with a pickup drum positioned above the horizontal portion of the conveyor so that the first side is no longer exposed and a second side of the pellet-shaped articles is exposed and faces a second marking device; and marking only the second side of the pellet-shaped articles with the second marking device.

12. The method of claim 11, further comprising discharging the pellet-shaped article from the manipulation device after the second marking device marks the second side.

* * * * *